US009536716B2

(12) United States Patent
Ikegami et al.

(10) Patent No.: US 9,536,716 B2
(45) Date of Patent: Jan. 3, 2017

(54) MALDI MASS SPECTROMETER WITH IRRADIATION TRACE FORMATION MEANS AND IRRADIATION TRACE IDENTIFIER FOR IDENTIFYING A MALDI SAMPLE PLATE

(75) Inventors: Masahiro Ikegami, Takaishi (JP); Takahiro Harada, Kizugawa (JP)

(73) Assignee: SHIMADZU CORPORATION, Kyoto-shi (JP)

( * ) Notice: Subject to any disclaimer, the term of this patent is extended or adjusted under 35 U.S.C. 154(b) by 0 days.

(21) Appl. No.: 13/029,040

(22) Filed: Feb. 16, 2011

(65) Prior Publication Data

US 2011/0198496 A1 Aug. 18, 2011

(30) Foreign Application Priority Data

Feb. 18, 2010 (JP) ..... 2010-033731

(51) Int. Cl.
*H01J 49/00* (2006.01)

(52) U.S. Cl.
CPC ..... *H01J 49/0004* (2013.01); *H01J 49/0009* (2013.01)

(58) Field of Classification Search
CPC ..... H01J 49/00; H01J 49/02; H01J 49/0418; H01J 49/16; H01J 49/164
(Continued)

(56) References Cited

U.S. PATENT DOCUMENTS 6,730,517 B1 * 5/2004 Koster et al. ..... 436/47
6,977,372 B2 * 12/2005 Valaskovic et al. ..... 250/288
(Continued)

FOREIGN PATENT DOCUMENTS

CN 201374493 12/2009
JP 2003016988 1/2003
(Continued)

OTHER PUBLICATIONS

Kiyoshi Ogawa et al., "Research and Development of Mass Microscope", Shimadzu Review, vol. 62, No. 3/4, pp. 125-135, Mar. 31, 2006.

(Continued)

*Primary Examiner* — Jason McCormack
(74) *Attorney, Agent, or Firm* — Morgan, Lewis & Bockius LLP

(57) ABSTRACT

When a sample plate 3 is set on a sample stage 2, an irradiation trace formation controller 22 appropriately moves the sample stage 2 and throws a short pulse of high-power laser beam to create an irradiation trace at a predetermined position on the sample plate 3. The irradiation trace has a unique shape. A microscopic image of the irradiation trace is captured and saved in an image storage section 32. After the sample plate 3 is temporarily removed from the stage 2 to apply a matrix to a sample, the sample plate 3 is re-set on the same stage 2. Then, the displacement of the sample plate 3 from its original position is calculated from the difference in the position of the irradiation trace between an image taken at that point in time and the image previously stored in the image storage section 32. Based on the calculated result, an analysis position corrector 24 modifies the position information of an area selected by an operator. Thus, the displacement of the re-set sample plate can be accurately detected. There is no need to use a special sample plate previously processed for creating a marker for displacement detection.

11 Claims, 7 Drawing Sheets

(58) Field of Classification Search
USPC ..... 250/281, 282
See application file for complete search history.

(56) References Cited

U.S. PATENT DOCUMENTS

| | | | | |
|---|---|---|---|---|
| 7,872,226 | B2 * | 1/2011 | Hohndorf et al. | 250/288 |
| 8,058,610 | B2 * | 11/2011 | Harada et al. | 250/288 |
| 2005/0045815 | A1 * | 3/2005 | Bui | H01J 49/0004 250/282 |
| 2005/0242277 | A1 * | 11/2005 | Russell et al. | 250/282 |
| 2006/0284079 | A1 * | 12/2006 | Overney | H01J 49/0418 250/288 |
| 2007/0045527 | A1 * | 3/2007 | Ogawa et al. | 250/281 |
| 2007/0258864 | A1 * | 11/2007 | Braymer et al. | 422/102 |
| 2008/0142703 | A1 * | 6/2008 | Schurenberg | G01N 1/28 250/288 |
| 2008/0191131 | A1 * | 8/2008 | Hohndorf et al. | 250/283 |
| 2008/0191136 | A1 * | 8/2008 | Shrader et al. | 250/316.1 |
| 2009/0057552 | A1 * | 3/2009 | Yamada | H01J 49/0418 250/288 |
| 2010/0005003 | A1 * | 1/2010 | Cassaday et al. | 705/23 |
| 2010/0021921 | A1 * | 1/2010 | Barthe et al. | 435/6 |
| 2010/0044563 | A1 * | 2/2010 | Harada | H01J 49/164 250/288 |
| 2010/0090101 | A1 * | 4/2010 | Schultz et al. | 250/282 |
| 2010/0116981 | A1 * | 5/2010 | Kajihara | 250/282 |
| 2012/0021924 | A1 * | 1/2012 | Hafner et al. | 506/7 |

FOREIGN PATENT DOCUMENTS

| | | | |
|---|---|---|---|
| JP | 2009-68995 | A | 4/2009 |
| WO | WO 2008/068847 | A1 | 6/2008 |

OTHER PUBLICATIONS

Takahiro Harada et al., "Biological Tissue Analysis using Mass Microscope" Shimadzu Review, vol. 64, No. 3/4, pp. 139-145, Apr. 24, 2008.

"flexControl User Manual", First Edition, Bruker Daltonics, Bremen, Germany, 2006, pp. 3-35.

Chinese Office Action dated May 23, 2013 for corresponding Chinese Patent Application No. 201110041262.9, English translation of "Reason for Rejection".

Japanese Office Action dated May 28, 2013 for corresponding Japanese Patent Application No. 2010-033731, English translation of "Reason for Rejection".

Examination report received for Japanese Patent Application No. 2013-141829, mailed on Jun. 10, 2014, 5 pages (2 pages of English Translation and 3 pages of Office Action).

* cited by examiner (a) MICROSCOPIC IMAGE OF SAMPLE PLATE BEFORE APPLICATION OF MATRIX (b) MICROSCOPIC IMAGE OF SAMPLE PLATE AFTER APPLICATION OF MATRIX

MALDI MASS SPECTROMETER WITH IRRADIATION TRACE FORMATION MEANS AND IRRADIATION TRACE IDENTIFIER FOR IDENTIFYING A MALDI SAMPLE PLATE

The present invention relates to a mass spectrometer, and particularly to an imaging mass spectrometer using an ion source for ionizing a sample by matrix assisted laser desorption/ionization (MALDI).

BACKGROUND OF THE INVENTION

Mass spectrometric imaging is a technique for investigating the distribution of a substance having a specific mass-to-charge ratio (m/z) by performing a mass analysis on each of a plurality of micro areas within a two-dimensional area of a sample, such as a piece of living tissue. This technique is expected to be applied, for example, in drug discovery, biomarker discovery, and investigation on the causes of various diseases. Mass spectrometers designed for mass spectrometric imaging are generally referred to as imaging mass spectrometers. This device may also be called a mass microscope since its operation normally includes performing a microscopic observation of an arbitrary area on the sample, selecting a region of interest based on the microscopically observed image, and performing a mass analysis of the selected region. For example, the configurations of commonly known mass microscopes and analysis examples obtained those mass microscopes are disclosed in International Publication No. WO 2008/068847; Kiyoshi OGAWA et al., "Kenbi Shitsuryou Bunseki Souchi No Kaihatsu (Research and Development of Mass Microscope)", *Shimadzu Hyouron* (*Shimadzu Review*), Vol. 62, No. 3/4, pp. 125-135, Mar. 31, 2006; and Harada et al. "Kenbi Shitsuryou Bunseki Souchi Ni Yoru Seitai Soshiki Bunseki (Biological Tissue Analysis using Mass Microscope", *Shimadzu Hyouron* (*Shimadzu Review*), Vol. 64. No. 3/4, pp. 139-145, Apr. 24, 2008.

A mass microscope is basically composed of a microscopic observation means for performing a microscopic observation of a two-dimensional area on a sample and a mass analysis means for performing a mass analysis for each of a plurality of portions within the two-dimensional area on the sample. The microscopic observation means can be divided into two major types: One type has an imaging means (e.g. a CCD camera) and a display unit (e.g. a monitor) with a screen on which an image taken with the imaging means can be displayed, thus allowing an operator to observe a sample image; the other type is a normal microscope having an eyepiece. The mass analysis means includes an ionization means for ionizing a component contained in a sample, an ion separation/detection means for separating the ions originating from the sample according to their mass-to-charge ratio and detecting each ion, and an ion transport means for guiding and transporting the ions generated from the sample to the ion-separating/detecting means. The microscopic observation means and the mass analysis means are not always provided in the same system; they can each be configured as a separate unit.

The primary subjects of analysis by the mass microscope are biological samples. Biological samples easily suffer from damage when irradiated with laser light. Accordingly, a matrix assisted laser desorption ion source (MALDI ion source) is normally used to ionize this type of sample. When the sample is a tissue section, the sample is in the form of an extremely thin slice (with a thickness of a few micrometers to several tens of micrometers) placed on a sample plate, on which a matrix solution is applied by an appropriate method, such as spraying or coating. In any application method, the sample surface is covered with a crystallized matrix after the solution is dried. Therefore, in many cases, the observed image of the sample becomes rather obscure.

When the region of interest for the mass spectroscopic imaging is selected on such an obscured sample image taken after the application of the matrix, it is difficult to correctly select the intended region. To accurately and properly perform the mass spectroscopic imaging, the target region must be determined based on a clear sample image taken before the application of the matrix. Accordingly, a procedure for mass spectroscopic imaging normally includes the following successive steps: a sample plate, with a sample placed thereon, is set in a mass spectrometer; an image of this sample is taken and saved as a sample image before matrix application; the sample plate is temporarily removed from the apparatus; a matrix is applied to the sample surface; the sample plate is re-set in the apparatus; and a mass analysis is performed on a region determined with reference to the sample image taken before the matrix application.

When being re-set in the apparatus, the sample plate may be set at a position displaced from the position where it was before its removal. If this occurs, the actual area of analysis will be displaced from the target region that has been selected with reference to the sample image taken before the application of the matrix. Such a displacement in the position of the re-set sample plate is much larger than the spatial resolution of the mass microscope, which is capable of performing the mass spectroscopic imaging with a spatial resolution of equal to or less than several tens of micrometers. Therefore, the aforementioned displacement poses a serious problem for accurately performing the mass spectroscopic imaging.

In the case where the microscopic observation means is configured as a separate microscope, the image of the sample placed on the sample plate, taken with the microscope, is initially saved in a memory of the microscope and subsequently read out by the mass spectrometer. After the sample plate is removed from the microscope and the matrix is applied on the sample surface, the sample plate is re-set in the mass spectrometer. The mass spectrometer performs the mass analysis on a region determined based on the microscopic image of the sample.

In this system, the position of the sample plate set in the mass spectrometer may be displaced from the position where the microscopic image of the sample plate was taken. If this occurs, the actual area of analysis will be displaced from the target region selected based on the sample image taken before the application of the matrix.

One method aimed at solving the aforementioned problem is disclosed in "flexControl User Manual", First Edition, Bruker Daltonics, Bremen, Germany, 2006, pp. 3-35. According to this method, before taking a microscopic image, an operator puts a mark for position recognition on the sample plate with a pen or the like. After setting the sample plate in the mass spectrometer, the operator locates the position-recognition mark on the sample plate through an imaging device annexed to the mass spectrometer and indicates the position of the mark. The position of this mark thus observed on the sample plate set in the apparatus is subsequently used as a reference point for controlling the position of the sample stage so that the measurement range selected on the microscopic image will be analyzed.

However, the mark that is manually put on the sample plate by the operator inevitably becomes large. Furthermore, the process of locating the mark on the sample plate set in the mass spectrometer uses a low-resolution image produced without using the microscope. The use of a large mark and a low-resolution image makes it difficult to improve the positioning accuracy.

In a mass spectrometer disclosed in WO2008/068847, which is configured as a single apparatus having a microscope and a mass analysis unit, a marker for position identification is originally provided on a sample plate. The magnitude and direction of the displacement of the sample plate between the first position where the sample plate was initially set and the second position where the sample plate is located after being re-set in the apparatus is calculated by comparing two images taken when the sample plate was at the first and second positions, respectively, During the analysis, the position of the sample stage is controlled so as to cancel the calculated displacement. The aforementioned document also discloses a technique for calculating the magnitude and direction of the displacement by means of a specific pattern or color that can be identified even after the application of the matrix.

Creating a sample plate with a marker for position identification requires special machining/processing work, which makes the sample plate more expensive and increases the operating cost of the analysis. Furthermore, comparing a portion of the sample images before and after the application of the matrix does not always provide satisfactorily accurate information about the displacement since this method is affected by the state of the applied matrix and the condition of the sample. For these reasons, it is desired to develop a method in which a conventional sample plate that requires no special work can be used, and in which the displacement of the sample plate can be accurately detected and cancelled by a technique different from the method of comparing sample images taken before and after the application of the matrix.

In some cases, such as an analysis of a set of samples prepared by consecutively slicing the same biological tissue, the prepared samples are extremely similar to each other in shape, pattern and color and hence difficult to be visually distinguished. As a result, one sample may be mistaken for another sample when the analysis is performed or the samples are put into storage. A method for preventing this problem has been desired.

After a sample plate carrying a sample with a matrix applied thereto is re-set in the apparatus, when the analysis is performed, it is necessary to retrieve from the storage device the sample image taken before the application of the matrix and determine the area of analysis. Searching for the sample image concerned consumes considerable time and labor if there are an enormous number of samples to be sequentially analyzed. This problem can be avoided by repeating the analyzing work for each sample. However, this method considerably deteriorates the throughput of the analysis since applying and drying a matrix normally requires a certain period of time.

The present invention has been developed in view of the previously described problems. Its first objective is to provide a mass spectrometer that allows the use of an inexpensive sample plate which requires no special processing, and yet can correctly detect and cancel the displacement of the sample plate resulting from its removal from and re-setting in the apparatus so as to perform the mass spectroscopic imaging on the intended area.

The second objective of the present invention is to provide a mass spectrometer capable of correctly identifying each sample and subjecting it to analysis even if there are a large number of samples having similar appearances.

The third objective of the present invention is to provide a mass spectrometer capable of quickly and correctly retrieving sample images taken before the application of the matrix and determining the area of analysis even in the case of analyzing a large number of samples.

SUMMARY OF THE INVENTION

The first aspect of the present invention aimed at solving the previously described problem is a mass spectrometer including an apparatus body in which a removable sample plate can be set and an ion source for ionizing a sample by a matrix assisted laser desorption ionization method including the successive steps of applying a matrix to a sample held on the sample plate removed from the apparatus body, setting the sample plate in the apparatus body, and throwing a laser beam from a laser irradiation unit onto the sample with the matrix applied thereto to ionize the sample, and the mass spectrometer further includes:

a) an irradiation trace formation means for forming an irradiation trace on the sample by throwing a laser beam from the laser irradiation unit to a predetermined position on the sample plate when the sample plate is set in the apparatus body, the laser beam having a higher energy than in the process of ionizing the sample;

b) a reference image capture means for capturing a microscopic image including the irradiation trace on the sample plate when the sample plate carrying the sample with no matrix applied thereto and having the irradiation trace formed thereon is set in the apparatus body, and for saving the captured image as a reference image;

c) a displacement detection means for calculating the magnitude and direction of the displacement of the sample plate occurring when the sample plate is re-set in the apparatus body, based on a change in the position of the irradiation trace observed on both the reference image and a microscopic image including the irradiation trace on the sample plate, the latter image being obtained when the sample plate carrying the sample with the matrix applied thereto is set in the apparatus body; and d) a displacement correction means for changing the relative position between the laser beam from the laser irradiation unit and the sample so as to cancel the displacement calculated by the displacement detection means, before a mass analysis is performed on an area of analysis on the sample, the area of analysis being selected with reference to a microscopic image of the sample captured concurrently with the capturing of the reference image.

The reference image capture means may include an imaging means using an image sensor, such as a CCD sensor or CMOS sensor.

The sample plate may be made of glass or metal, but is not limited to these materials. Any material can be used as long as a pit-like irradiation trace can be formed on the sample plate by throwing a thin laser beam onto the plate.

In the mass spectrometer according to the present invention, for example, when a sample plate carrying a sample with no matrix applied thereto is set in the apparatus body (e.g. when it is placed on a sample stage), an irradiation trace is formed at a predetermined position on the sample plate by the irradiation trace formation means before an image is captured by the reference image capture means. If clear recognition of the shape of the irradiation trace is required, the irradiation trace should be formed at a position on the sample plate where no matrix will be applied.

For the sample plate having an irradiation trace formed in the aforementioned manner, the reference image capture means captures and saves a microscopic image which includes at least the irradiation trace. Subsequently, the sample plate is temporarily removed from the apparatus body and later re-set in the same body after a matrix is applied to the sample. If the position of the sample plate is displaced from the position where the plate was previously located, the position of the irradiation trace will also be displaced. Accordingly, the displacement detection means detects the displacement of the irradiation trace by comparing the reference image taken before the removal of the plate with a currently captured image, and calculates the magnitude and direction of the displacement. This calculation may be performed taking into account only the translational displacement or both the translational and rotational displacements.

The operator selects an area of analysis on a sample, for example, by referring to the sample observation image taken before the removal of the sample plate. When a mass analysis on this area is performed, the displacement correction means corrects the aforementioned displacement, for example, by deflecting the laser beam or correcting the amount of movement of the sample stage on which the sample plate is placed. Therefore, even if the re-set sample plate is displaced from its original position, the analysis will be performed on the selected area of the sample with high positional accuracy.

Even if the laser beam is thrown onto the same type of sample plate under the same conditions (e.g. the energy and spot diameter of the beam), each irradiation trace formed on the sample plate by the laser beam will normally have a different visual feature (e.g. shape, size and/or color). That is to say, the irradiation trace is as unique as the fingerprint of a person or the linear scar of a bullet, so that it can be used to identify each sample plate (and the sample on the plate).

Accordingly, in the first aspect of the present invention, the displacement calculation means recognizes a visual feature of the irradiation trace as well as the position thereof in the process of detecting the displacement of the irradiation trace by an image analysis, such as image comparison, and makes a judgment on the identity of the sample plate on the basis of the visual feature of the irradiation trace.

For example, when a sample plate with a matrix applied thereto is set in the apparatus body, a reference image having the same visual feature as that of the irradiation trace on the sample plate can be retrieved, and the displacement detection can be made with reference to this image. As another example, when a sample plate with a matrix applied thereto is set in the apparatus body, if there is no reference image that shows an irradiation trace having the same visual feature as that of the irradiation trace on the sample plate, the apparatus may determine that the displacement correction necessary for a correct analysis cannot be carried out, and hence alert the operator to the situation or prohibit the initiation of the analysis.

By this method, even in the case of measuring a large number of samples, no sample will be mistaken for another sample before and after the application of the matrix. The operator is released from the task of searching for a reference image since the correct reference image can be automatically retrieved from a large number of reference images taken before the application of the matrix and saved in a storage device or the like. Even if a large number of samples are subjected to the analysis in an arbitrary order, the displacement of each sample plate can be detected by using the reference image of the currently selected sample plate taken before the application of the matrix. Therefore, the throughput of the analysis improves.

As stated earlier, the irradiation trace can be used for identifying each sample plate. Therefore, it is possible use the irradiation trace as an identifier for distinguishing sample plates (and samples). Thus, in one mode of the first aspect of the present invention, the mass spectrometer further includes an information memory means for using, as an identifier, the visual feature of the irradiation trace formed on the sample plate by the irradiation trace formation means, for associating measurement information relating to the sample plate or the sample with the identifier and for memorizing the measurement information, and an information retrieval means for recognizing the visual feature of the irradiation trace on a microscopic image of the sample plate taken when the sample plate is set in the apparatus body, and for referring to the information memory means to retrieve the measurement information corresponding to the sample plate concerned.

For example, the measurement information, which is linked with the identifier when memorized, is the date and time of the measurement, the measurement conditions, the sample discrimination number, and the source of the sample, or any other information. This technique is convenient for the management of samples and also helps automating the management. It also facilitates the re-measurement or verification of the samples and other tasks.

The irradiation trace created by laser irradiation can be formed at any number of positions and at any location on the sample plate. Therefore, it is possible to create a plurality of irradiation traces whose arrangement or pattern directly represents a specific meaning. Accordingly, in another mode of the mass spectrometer according to the first aspect of the present invention, the measurement information relating to the sample plate or the sample is associated with the arrangement or pattern of a plurality of irradiation traces formed on the sample plate by the irradiation trace formation means so that the sample plate itself can hold the measurement information.

In this case, each irradiation trace can be regarded as a mere pit (hole). Recognizing such an irradiation trace is easier than recognizing the visual feature of the irradiation trace and identifying the sample plate based on the visual feature. Therefore, the present mode is advantageous for increasing the speed of image recognition or reducing the loads on hardware and software components.

In the mass spectrometer according to the first aspect of the present invention, the irradiation trace, which is intentionally formed on the sample plate by laser irradiation, is used for the displacement detection. It is also possible to use a characteristic microstructure that is unintentionally formed on the sample plate in the process of producing the sample plate.

Thus, the second aspect of the present invention aimed at solving the previously described problem is a mass spectrometer including an apparatus body in which a removable sample plate can be set and an ion source for ionizing a sample by a matrix assisted laser desorption ionization method including the successive steps of applying a matrix to a sample held on the sample plate removed from the apparatus body, setting the sample plate in the apparatus body, and throwing a laser beam from a laser irradiation unit onto the sample with the matrix applied thereto to ionize the sample, and the mass spectrometer further includes:

a) a reference image capture means for capturing a microscopic image of the surface of the sample plate when the sample plate carrying the sample with no matrix applied thereto is set in the apparatus body, and for saving the captured image as a reference image;

b) a displacement detection means for calculating the magnitude and direction of the displacement of the sample plate occurring when the sample plate is re-set in the apparatus body, based on a change in the position of a scratch pattern recognized on both the reference image and a microscopic image of the surface of the sample plate, the latter image being obtained when the sample plate carrying the sample with the matrix applied thereto is set in the apparatus body, and the scratch pattern being formed on the surface of the sample plate in the process of producing the sample plate; and c) a displacement correction means for changing the relative position between the laser beam from the laser irradiation unit and the sample so as to cancel the displacement calculated by the displacement detection means, before a mass analysis is performed on an area of analysis on the sample, the area of analysis being selected with reference to a microscopic image of the sample captured concurrently with the capturing of the reference image.

The third aspect of the present invention aimed at solving the previously described problem is a mass spectrometer including an apparatus body in which a removable sample plate can be set and an ion source for ionizing a sample by a matrix assisted laser desorption ionization method including the successive steps of applying a matrix to a sample held on the sample plate removed from the apparatus body, setting the sample plate in the apparatus body, and throwing a laser beam from a laser irradiation unit onto the sample with the matrix applied thereto to ionize the sample, and the mass spectrometer further includes:

a) a reference image capture means for capturing a microscopic image including a corner of the sample plate when the sample plate carrying the sample with no matrix applied thereto is set in the apparatus body, and for saving the captured image as a reference image;

b) a displacement detection means for calculating the magnitude and direction of the displacement of the sample plate occurring when the sample plate is re-set in the apparatus body, based on a change in the position of the corner recognized on both the reference image and a microscopic image including the corner of the sample plate, the latter image being obtained when the sample plate carrying the sample with the matrix applied thereto is set in the apparatus body; and c) a displacement correction means for changing the relative position between the laser beam from the laser irradiation unit and the sample so as to cancel the displacement calculated by the displacement detection means, before a mass analysis is performed on an area of analysis on the sample, the area of analysis being selected with reference to a microscopic image of the sample captured concurrently with the capturing of the reference image.

In the mass spectrometer according to the second aspect of the present invention, an unintentionally formed scratch pattern on the surface of the sample plate is used as the aforementioned characteristic microstructure for displacement detection. The process of producing sample plates includes polishing work to eventually obtain a smooth surface. This work leaves fine characteristic scratches on the surface of each sample plate. The pattern of this polishing scratch is invisible to the naked eye but can be clearly observed on microscopic images. Accordingly, for example, the contours of the polishing scratches are extracted from two microscopic images of the surface of the sample plate respectively taken before and after the application of the matrix, and the same contour is identified on both images to detect the displacement.

On the other hand, in the mass spectrometer according to the third aspect of the present invention, a fine shape at a corner of the sample plate is used as the aforementioned characteristic microstructure for displacement detection. Sample plates are normally produced by dividing a large plate-like material into smaller pieces. This work inevitably creates fine structures (e.g. burrs), each of which has a characteristic form. Accordingly, for example, the edge contour or the like of a corner is extracted from two microscopic images of the surface of the sample plate respectively taken before and after the application of the matrix, and the same contour is identified on both images to detect the displacement.

It is naturally possible to simultaneously use both the first and second aspects of the present invention.

In any of the first through third aspects of the present invention, the magnitude and direction of the displacement can be more correctly and easily calculated by using a plurality of portions of the sample plate for the displacement detection rather than only one portion. In that case, it is preferable to provide the greatest possible distances between those portions.

The mass spectrometers according to the first through third aspects of the present invention can accurately detect the displacement of the sample plate resulting from the removal and re-setting operations without using any microscopic image of the sample itself, while allowing the use of an inexpensive sample plate that requires no special processing. Therefore, it is possible to suppress the operating cost of the analysis by using normal, inexpensive sample plates, and yet correctly select a desired point or area on the sample to assuredly obtain a mass analysis result or substance distribution image as intended. The displacement can be correctly detected even if the pattern or color of the sample is obscured by the applied matrix. This means that there is a greater degree of freedom for the choice of the method for applying the matrix and the amount of matrix to be applied, which is also advantageous for efficiently performing the analysis work.

In the mass spectrometer according to the first aspect of the present invention, measurement information can be associated with each sample plate by using a visual feature of an irradiation trace or the arrangement or pattern of a plurality of irradiation traces, whereby each sample can be correctly identified and prevented from being mistaken for another sample even in the case of handling a large number of samples or analyzing a plurality of samples having extremely similar appearances. Furthermore, even if there are an enormous number of reference images, the reference image corresponding to the target sample can be retrieved without imposing any workload on the operator. This also contributes to improving the throughput of the analysis.

DETAILED DESCRIPTION OF A PREFERRED EMBODIMENT

First Embodiment

Figure 1:
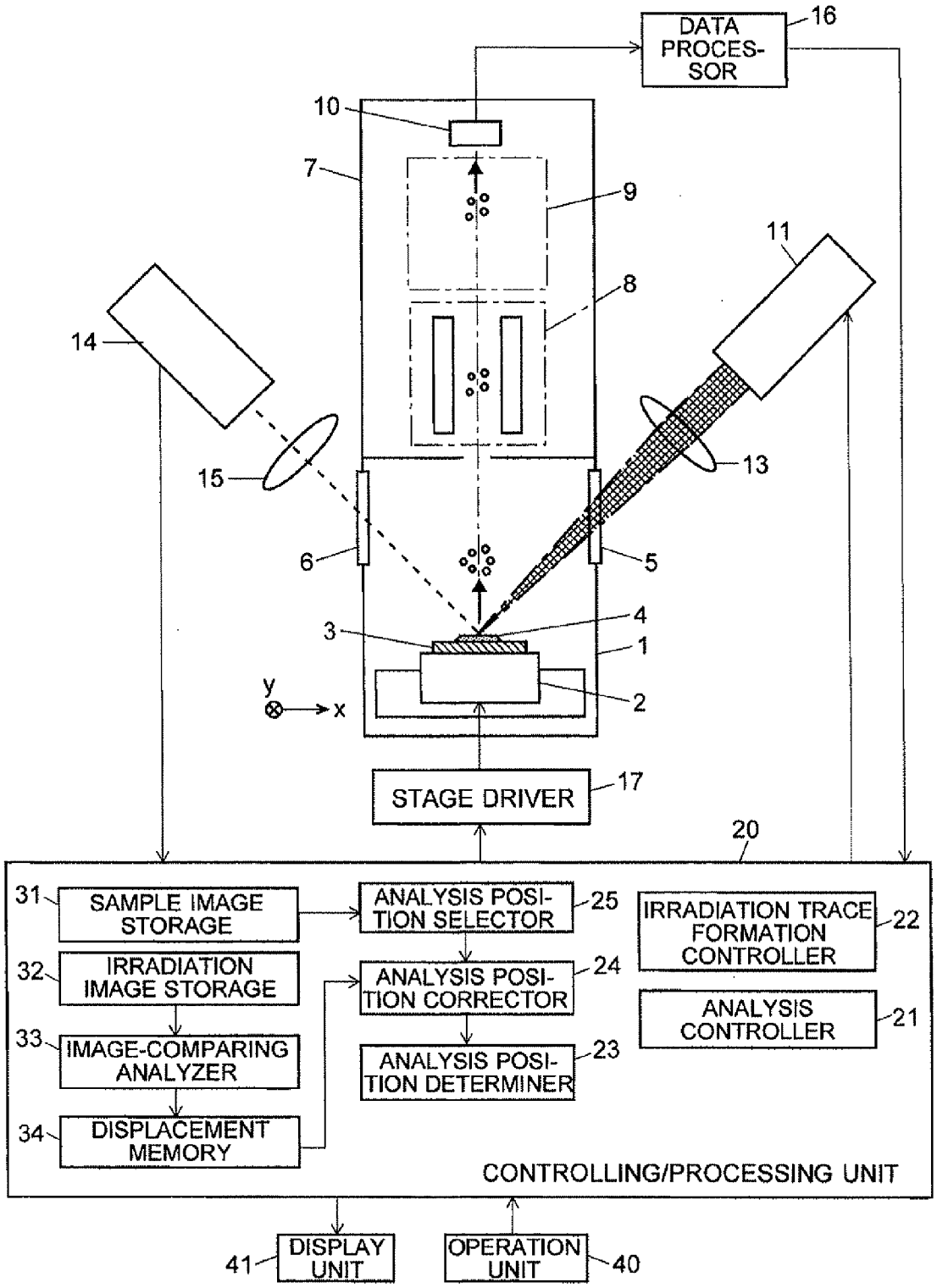
FIG. 1 is a configuration diagram showing the main components of an imaging mass spectrometer according to the first embodiment of the present invention.

An imaging mass spectrometer, which is one embodiment (first embodiment) of the mass spectrometer according to the present invention, is hereinafter described with reference to FIGS. 1-4. FIG. 1 is a configuration diagram showing the main components of an imaging mass spectrometer according to the present embodiment.

A sample stage 2, on which a sample plate 3 with a sample 4 placed thereon is to be set, is provided inside an air-tight, non-vacuum chamber 1. This chamber 1 is connected to a vacuum chamber 7, which can be evacuated by a vacuum pump (not shown). The vacuum chamber 7 contains an ion-transport optical system 8, a mass analyzer 9, an ion detector 10 and other components. A laser irradiation unit 11, a laser-condensing optical system 13, a CCD camera 14, an observation optical system 15 and other components are provided outside the non-vacuum chamber 11 and the vacuum chamber 7. The ion-transport optical system 13, for example, is an electrostatic electromagnetic lens, a multipole radio-frequency ion guide, or a combination of these devices. As the mass analyzer 9, various types of devices are available, such as the quadrupole mass filter, ion trap, time-of-flight mass analyzer or magnetic-field sector type analyzer.

The sample stage 2 is provided with a drive mechanism (not shown) including a stepping motor and other components for precisely driving the sample stage 2 in two directions along the mutually orthogonal x and y axes. This mechanism is driven by a stage driver 17.

Under the control of the controlling/processing unit 20, the laser irradiation unit 11 emits an ionizing laser beam, which is focused by the laser-condensing optical system 13 and thrown onto the sample 4 through an irradiation window 5 provided on one side of the non-vacuum chamber 1. The spot diameter of the laser beam on the sample 4, for example, is within a range from 1 micrometer to a few tens of micrometers. The irradiation point of the laser beam on the sample 4 (i.e. a micro area on the sample 4 to be subjected to the mass analysis) can be changed by moving the sample stage 2 in the x-y plane. In this manner, the point at which the mass analysis is to be performed is two-dimensionally moved on the sample 4. The mass analysis is performed on each of the micro areas arranged in a grid-like pattern within a two-dimensional area of an arbitrary shape.

The CCD camera 14 takes images of a predetermined range on the sample plate 3 through the observation window 6, which is provided on one side of the non-vacuum chamber 1, and the observation optical system 15. The image signals produced by the CCD camera 14 are sent to the controlling/processing unit 20 and, if necessary, stored in the sample image storage section 31 or the irradiation trace image storage section 32. The controlling/processing unit 20 also includes an image-comparing analyzer 33, displacement memory 34, analysis controller 21, irradiation trace formation controller 22, analysis position selector 25, analysis position corrector 24, and analysis position determiner 23. Additionally, an operation unit 40 for allowing an operator to operate the system and enter commands and a display unit 41 for showing a surface observation image or two-dimensional substance distribution image of the sample 4 are connected to the controlling/processing unit 20.

The ions released from the sample 4 due to the irradiation with a short pulse of laser beam are introduced into the vacuum chamber 7 and transferred through the ion-transport optical system 8 into the mass analyzer 9, which separates different kinds of ions according to their mass-to-charge ratio (m/z value). When the separated ions reach the ion detector 10, the ion detector 10 produces a detection signal corresponding to the amount of incident ions. This signal is sent to the data processor 16, which converts the detection signals into digital data and appropriately processes the data. For example, in the case where a mass analysis is performed on one or more local points on the sample 4, the data processor 16 may create a mass spectrum for each local point and perform a qualitative or qualitative analysis based on the obtained mass spectrum to identify the substances existing at the point or estimate their contents. In the case of the mass analysis of a specific area on the sample 4, the signal intensity of a specific m/z value is determined every time the laser irradiation point is shifted by the previously described movement of the sample stage 2, and the obtained data is processed to create a mapping image showing the two-dimensional distribution of the measured signal intensity.

At least part of the previously described functions of the controlling/processing unit 20 and the data processor 16 can be realized by running a dedicated software program on a personal computer. In this case, the components included in the controlling/processing unit 20 correspond to the functional blocks realized by the software.

Figure 2:
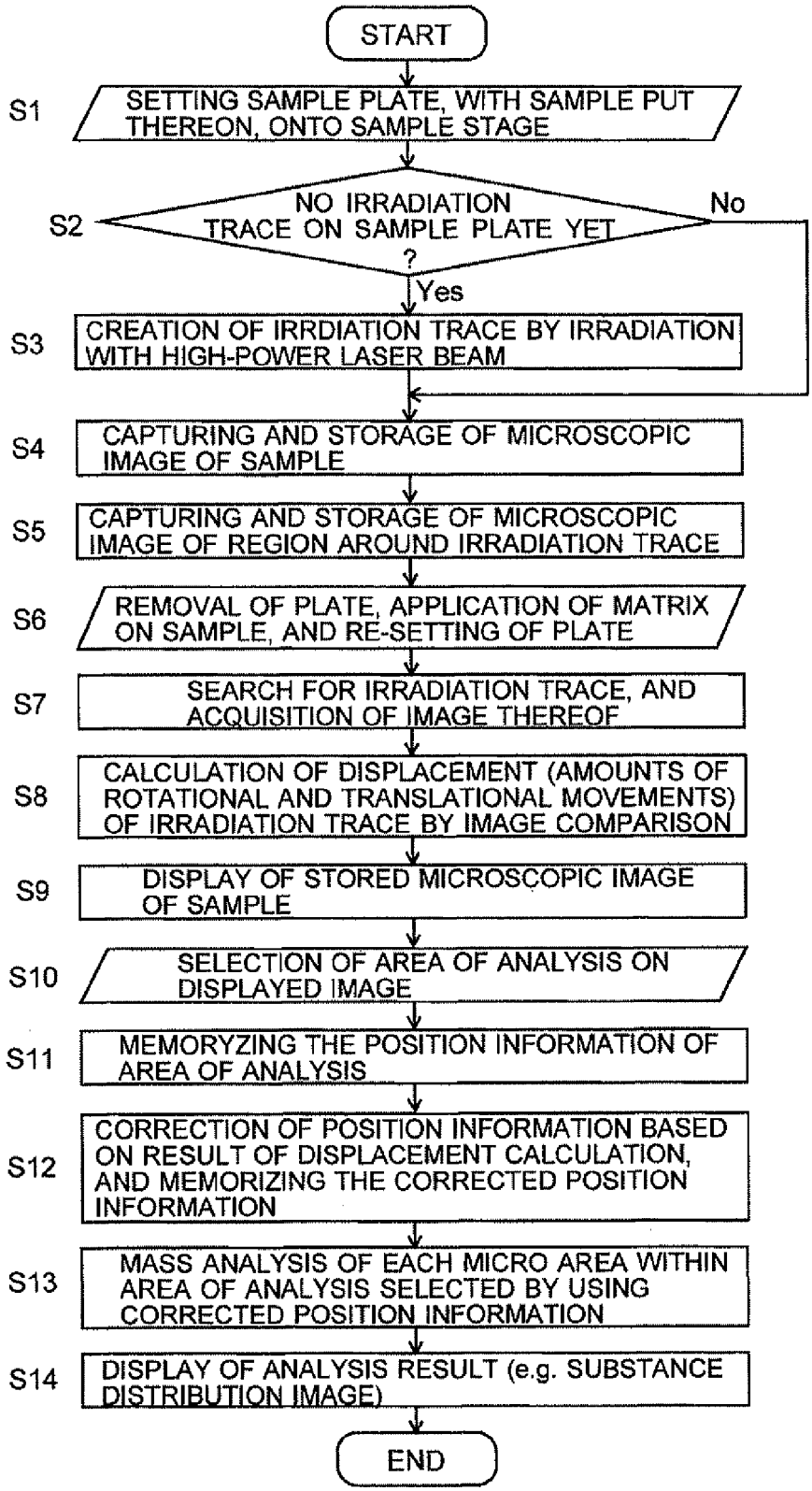
FIG. 2 is a flowchart showing an analysis procedure and process operation in the imaging mass spectrometer of the first embodiment.

The procedure of an analysis using the imaging mass spectrometer of the present embodiment and a process operation of the apparatus during the analysis are hereinafter described with reference to FIG. 2. FIG. 2 is a flowchart showing an example of the analysis procedure of the present imaging mass spectrometer and a process operation associated with the procedure.

To begin with, an operator puts a sample 4 to be analyzed (e.g. a slice of biological tissue) on a sample plate 3 outside the non-vacuum chamber 1, and sets the sample plate 3 on the sample stage 2 (Step S1).

When a predetermined command is entered through the operation unit 40, the controlling/processing unit 20 determines whether a laser-irradiation trace is already present on the set sample plate 3 (Step S2). For this determination, it is preferable to provide a means by which the operator can input, through the operation unit 40, information indicative of whether the sample plate 3 is a used or unused one. It is also possible to perform, under the control of the controlling/processing unit 20, automatic image recognition in which a microscopic image of the surface of the sample plate 3 taken with the CCD camera 14 is examined to determine whether a laser-irradiation trace is already present. If no laser-irradiation trace is present on the sample plate 3, the operation proceeds from Step S2 to Step S3. If a laser-irradiation trace has been found, the operation bypasses Step S3 and proceeds to Step S4.

In Step S3, the irradiation trace formation controller 22 controls the stage driver 17 to move the sample stage 2 to a position where a predetermined point on the sample plate 3 coincides with the laser irradiation point. After the predetermined point on the sample plate 3 has reached the laser irradiation point, the laser irradiation unit 11 increases the output energy to a higher level than the normal level used for the analysis, thus throwing a high-power laser beam onto the sample plate 3. At a portion near the laser irradiation point, the sample plate 3 melts due to the heat, whereby a pit-like irradiation trace is formed.

Figure 3:
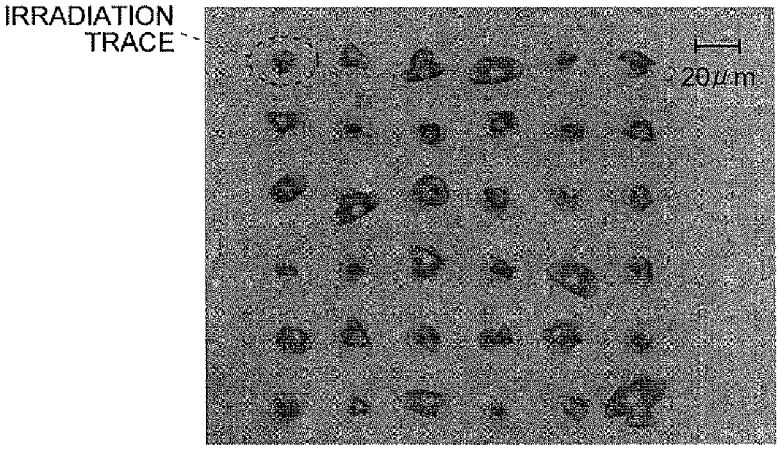
FIG. 3 is a photographic image showing examples of laser-irradiation traces formed on a sample plate made of glass.

FIG. 3 shows examples of irradiation traces formed on a sample plate made of glass by irradiation with a high-power laser beam. Although a laser beam having the same power and the same spot diameter was thrown onto every point shown in the image, the irradiation traces had considerably different appearances (e.g. sizes, contour shapes, and colors). In practical situations, it is least likely that two or more irradiation traces having the same appearance are formed. Therefore, similar to the fingerprint of a person or the linear scar of a bullet, the irradiation trace can be used to identify each sample plate. Since no irradiation trace will have a truly circular shape, forming a single irradiation trace is sufficient to detect the rotational displacement by the method which will be described later.

It is preferable to provide a means for allowing operators to arbitrarily select the position where the irradiation trace will be formed on the sample plate 3. Since the sample 4 is normally put at the center of the sample plate 3, the aforementioned position may be selected so that the irradiation trace will be formed at an end of the sample plate 3, e.g. near a corner thereof, to thereby prevent the irradiation trace from being covered with the matrix.

When the operator enters an imaging command through the operation unit 40, the controlling/processing unit 20 receives this command and controls the CCD camera 14 to take a microscopic image of the sample 4 and displays it on the screen of the display unit 41. The microscopic image thus shown on the display unit 41 is a real-time image. Watching this image, the operator changes the magnification of the microscope and/or changes the position of the sample stage 2. When an appropriate area on the sample plate 3 is displayed, the operator performs an image-fixing operation. Upon this operation, the current microscopic image is stored in the sample image storage section 31 (Step S4). In this process, position information of the sample stage 2 (e.g. the addresses in the x and y directions) is associated with the sample observation image and stored.

Next, the sample stage 2 is moved to a position where the irradiation trace formed on the sample plate 3 is included in the visual field observed by the CCD camera 14. At this position, the CCD camera 14 captures a microscopic image including the irradiation trace, and this image is stored as the reference image in the irradiation trace image storage section 32 (Step S5). It is unnecessary to include the sample 4 in this reference image. The position information of the sample stage 2 at the point of capturing of this reference image is also associated with the image and stored. For example, as shown in FIG. 4(*a*), the sample stage 2 is moved to the position where the center of the irradiation trace P (e.g. the center of gravity) 51 coincides with the center of the visual field 50, and the microscopic image at this position is stored as the reference image.

Next, the operator temporarily removes the sample plate 3 from the sample stage 2 to apply a matrix solution to the sample 4. This task can be made by using any matrix application method. However, in most cases, the method of spraying the matrix solution is useful to achieve high spatial resolution. After the matrix is applied to the sample 4, the sample plate 3 is re-set on the sample stage 2 (Step S6). Since the position at which the sample plate 3 can be placed on the sample stage 2 is roughly specified, the re-set sample plate 3 will not be considerably displaced from the position where it was located before the application of the matrix. However, a displacement equal to or larger than the spatial resolution can easily occur.

After the sample plate 3 is returned to the sample stage 2, when the operator performs a predetermined operation on the operation unit 40, the sample stage 2 is moved to the position indicated by the position information of the sample image 2 obtained when the microscopic image of the irradiation trace was taken. At this position, the CCD camera 14 once more captures a microscopic image of the irradiation trace (Step S7). If there is no displacement of the sample plate 3 due to the removal and re-setting, the microscopic image of the irradiation trace taken in this step should perfectly overlap the previous microscopic image of the irradiation trace stored in the irradiation trace image storage section 32. Conversely, when the sample plate 3 is displaced, the irradiation traces in the two microscopic images will be located at different positions. Accordingly, the image-comparing analyzer 33 compares these two images. More specifically, it compares the shape, color and/or other visual features of the irradiation trace, calculates the rotational and translational displacements as the displacement values, and saves these values in the displacement memory 34 (Step S8).

Figure 4:
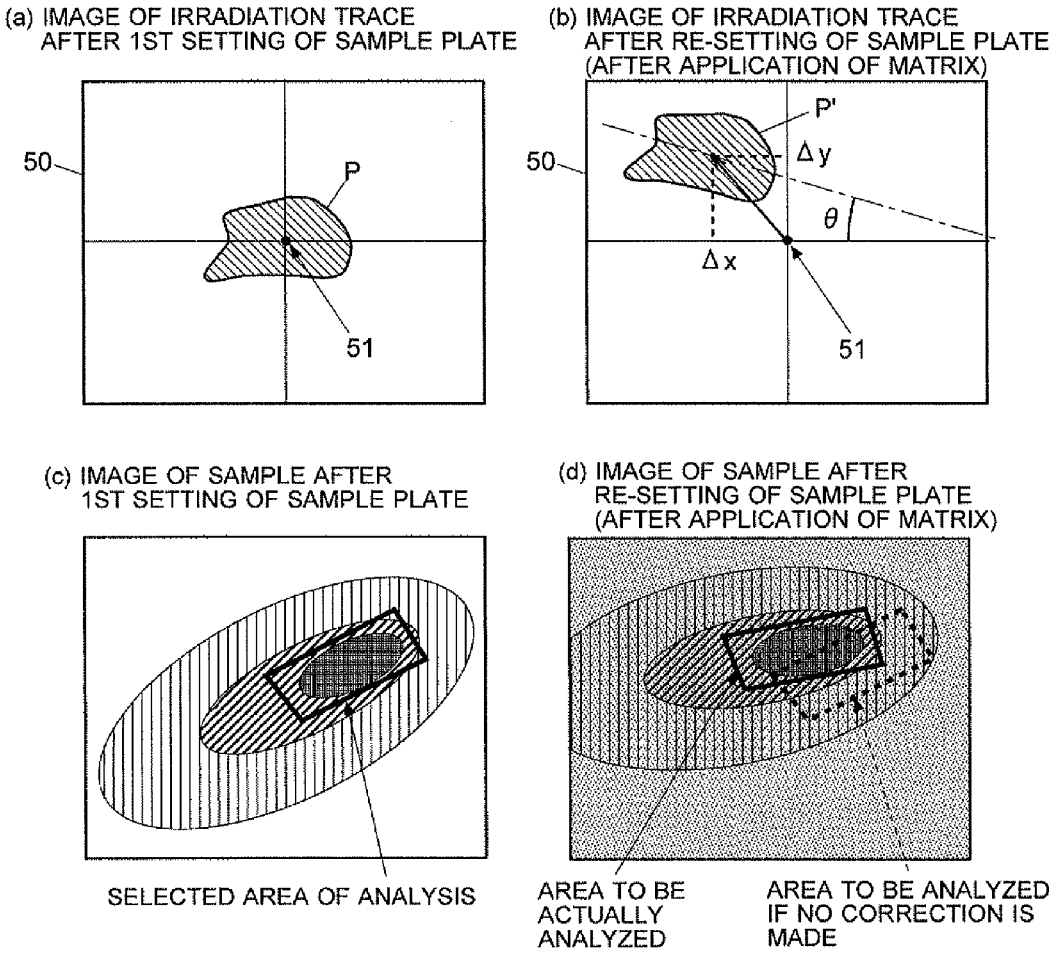
FIGS. 4(*a*)-4(*d*) are diagrams illustrating a displacement correction method in the imaging mass spectrometer of the first embodiment.

For example, consider the case where the microscopic image shown in FIG. 4(*b*) has been obtained after the sample stage 2 has been moved to the position based on the position information obtained when the microscopic image shown in FIG. 4(*a*) was captured. By comparing the images of FIGS. 4(*a*) and 4(*b*) by the image-comparing analyzer 33, it is demonstrated that the center of the irradiation trace P', which should be at the center 51 of the visual field 50, is displaced by ($\Delta x$, $\Delta y$) in the translational direction and by an angle of $\theta$ in the rotational direction. These two kinds of displacements, which respectively correspond to the translational and rotational displacements, are saved.

The analysis position selector 25 retrieves, from the sample image storage section 31, the microscopic image of the sample 4 on the sample plate 3 concerned, and displays this image on the screen of the display unit 41. Thus, a clear microscopic image of the sample 4 taken before the application of the matrix is shown on the display unit 41 (Step S9). Even if the sample 4 actually set on the sample stage 2 is covered with the matrix and no clear image can be captured in real time, a clear image of the sample that is not covered with the matrix is displayed on the screen of the display unit 41.

On this microscopic image of the sample 4, the operator selects a desired area of analysis (Step S10). For example, this can be achieved by designing the analysis position selector 25 so that any line can be drawn on the sample observation image by means of the operation unit 40, such as a mouse, and the area surrounded by this line is selected as the area of analysis. Of course, this is not the only possible method for selecting the area of analysis. For example, numerical entry of the coordinate values through a keyboard is also a possible choice. FIG. 4(*c*) is an example of a screen image showing a rectangular area of analysis selected on the sample observation image.

After the area of analysis is determined, the position information of the area of analysis can be obtained on the basis of the position information of the microscopic image of the sample taken before the application of the matrix. The analysis position corrector 24 temporarily memorizes this information (Step S11). Subsequently, the analysis position correction means 24 correct the position information of the area of analysis by using the displacement information (the translational and rotational displacements) memorized in the displacement memory 34. The analysis position determiner 23 memorizes the corrected position information (Step S12). The corrected position information corresponds to the intended area selected by the operator on the sample 4 currently set on the sample stage 2. FIG. 4(*d*) shows the area of analysis that is selected on the sample 4 at that point in time. If no correction is made, the area of analysis will be as indicated by the dotted-line frame. The corrected area is indicated by the solid-line frame, which correctly corresponds to the selected area of analysis shown in FIG. 4(*c*)

Upon receiving a command for initiating the analysis, the analysis controller 21 controls the drive mechanism through the stage driver 17 so that the micro area irradiated with the laser beam will move in a stepwise manner within the area of analysis, based on the corrected position information of the area of analysis memorized in the analysis position determiner 23. By this operation, the sample stage 2 is gradually moved, with a small distance for each step. Every time the sample stage 2 is halted after moving over the small distance, a pulsed laser beam is thrown from the laser irradiation unit 11 to perform a mass analysis on the micro area on the sample 4 (Step S13). After the mass analysis for all the micro areas within the area of analysis selected on the sample 4, the data processor 16 creates, for example, a mapping image showing the distribution of the signal intensity at a specific m/z value and displays the image on the screen of the display unit 41 (Step S14).

The analysis procedure and process operation is basically the same even in the case of performing the analysis on a single point or a plurality of separately located points rather than a two-dimensional area on the sample 4.

In the previously described example, the operation of selecting the area of analysis on the sample 4 is performed after the sample plate 3 with a matrix applied thereto is set on the sample stage 2. However, this operation can be similarly performed at any point in time after the sample image to be used for selecting the area of analysis is obtained, e.g. even when a sample plate 3 before the application of the matrix is set on the sample stage 2 or no sample plate 3 is present on the sample stage 2.

In the previous embodiment, the calculation of the amount of displacement used a single irradiation trace. However, depending on the shape of the irradiation trace, it may be difficult to correctly determine the amount of rotational displacement. Accordingly, it is preferable to create two or more irradiation traces and calculate the rotational displacement from the difference in the position information of these irradiation traces.

For example, consider the case where the center Q1 (e.g. the center of gravity) of one irradiation trace and the center Q2 of another irradiation trace have moved to the points Q1' and Q2', respectively, as a result of the displacement of the sample plate. In this case, two vectors can be drawn. Provided that the displacement simply takes place in the rotational and translational directions with neither enlargement nor reduction of the image, the amounts of rotational and translational movements from one image S to the other image S' can be calculated from the two vectors.

Second Embodiment

Figure 5:
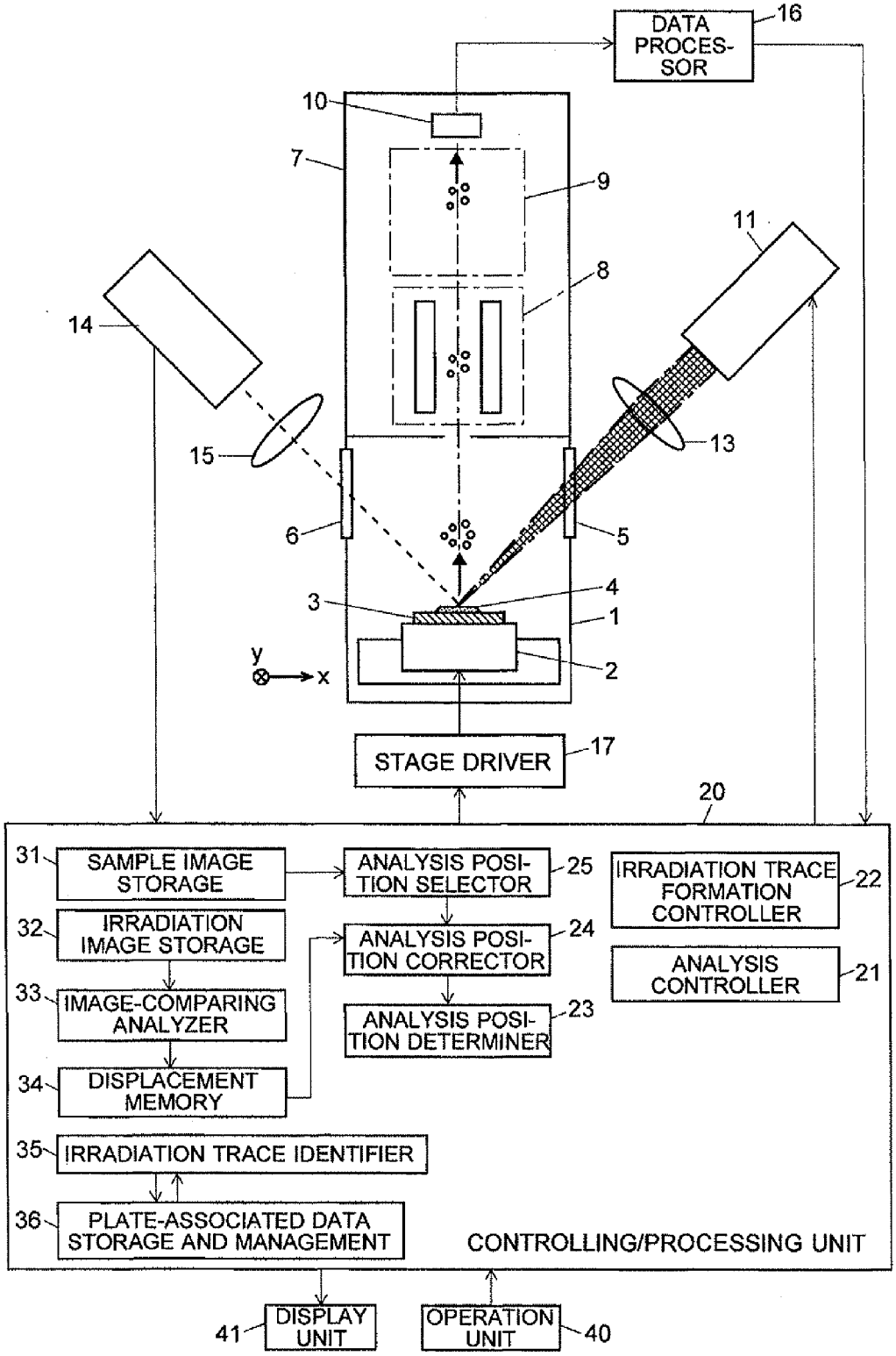
FIG. 5 is configuration diagram showing the main components of an imaging mass spectrometer according to the second embodiment.

As already noted, the shape of the irradiation trace is unique to each sample plate. Therefore, it is possible to specify (identify) each of a set of sample plates and manage the sample plates by using the irradiation trace. The imaging mass spectrometer according to the second embodiment is additionally provided with such a function. FIG. 5 is a configuration diagram of the main components of the imaging mass spectrometer according to the second embodiment. The same components as used in the system of the first embodiment are denoted by the same numerals.

The mass spectrometer of the second embodiment includes an irradiation trace identifier 35 and a plate-associated data storage and management section 36 as functional blocks included in the controlling/processing unit 20. The irradiation trace identifier 35 analyzes the microscopic image of the irradiation trace on the sample plate 3, extracts characteristic points from the shape of the irradiation trace, and saves data representing the characteristic points (this data is hereinafter called the "shape-characteristic data") as part of the plate-associated data in the plate-associated data storage and management section 36, or compares the obtained data with the previously-saved plate-associated data. The plate-associated data are a set of data in which various kinds of information are recorded for each sample plate, such as the information on the sample put on the plate (e.g. the source of the sample, sampling date, and sample identification number) and the information on the measurement (e.g. the measurement conditions, measurement date, measurer's name, and measurement system identification number). The aforementioned shape-characterizing data of the irradiation trace is used as the information for identifying each of the sample plates that are difficult to distinguish by their appearance.

In the mass spectrometer of the second embodiment, for example, when a microscopic image of the irradiation trace on the sample plate 3 with no matrix applied thereto is captured in Step S5, the irradiation trace identifier 35 obtains the shape-characterizing data of the irradiation trace from the captured image and searches the plate-associated data storage and management section 36 for the obtained data. If no data corresponding thereto is found, a new data area with the shape-characterizing data of the irradiation trace as the search key is created. The operator can enter the aforementioned information relating to the sample plate through the operation unit 40 at any point in time. The entered information is stored in the data area provided in the plate-associated data storage and management section 36 and can be searched for and retrieved by using the shape-characterizing data of the irradiation trace as the search key.

The information stored in the plate-associated data storage and management section 36 can be used for various purposes and applications. For example, when a sample plate with a matrix applied thereto is set on a sample stage 2 to initiate an analysis, the irradiation trace identifier 35 can search the plate-associated data storage and management section 36 for the information associated with the shape of the irradiation trace formed on the currently set sample plate 3 and show the retrieved information on the display unit 14. From this information, the operator can confirm that the currently set sample is the correct sample to be analyzed. If the sample concerned has the record of a previous analysis, the record can be used to show the conditions and results of the previous analysis.

Third Embodiment

Figure 6:
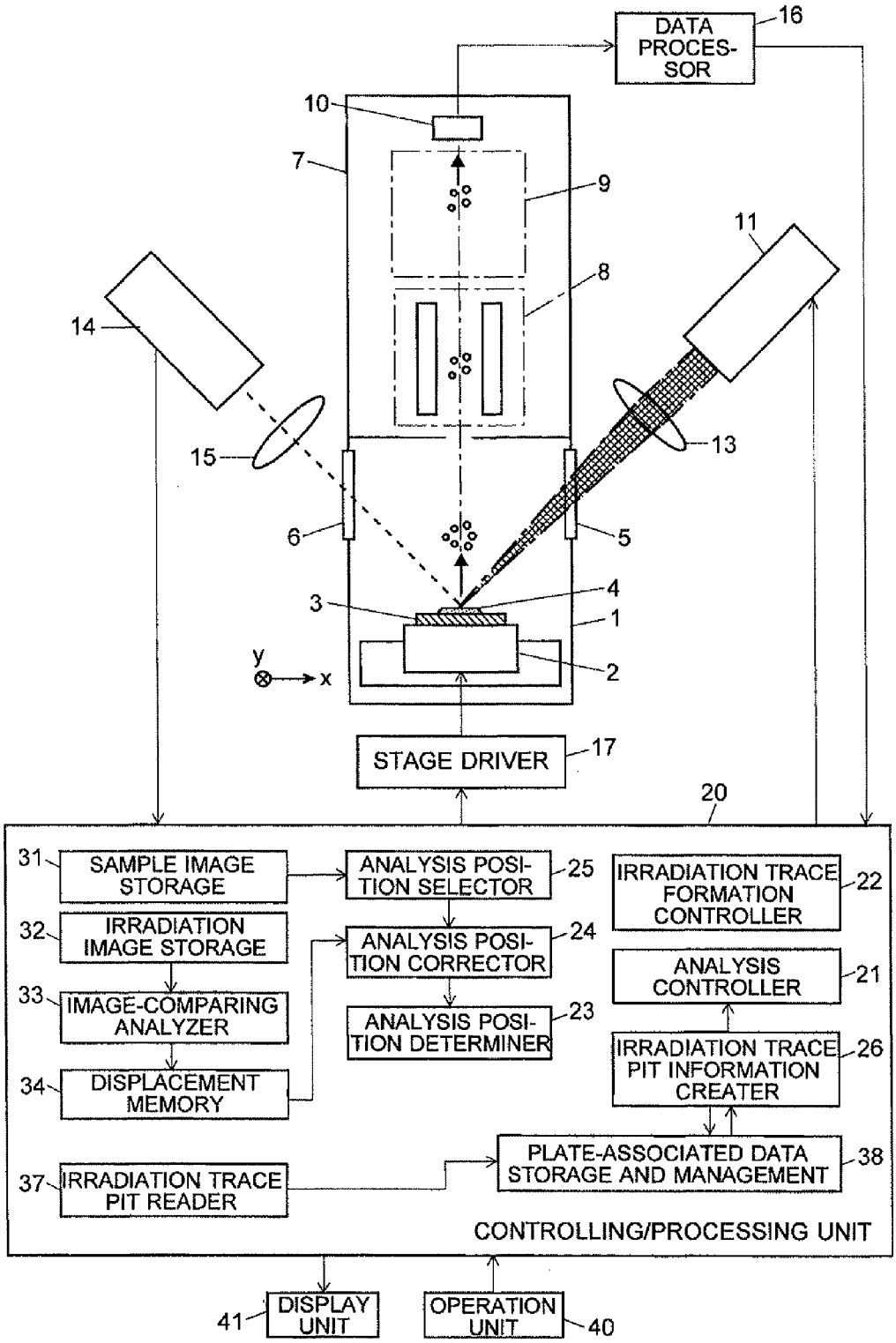
FIG. 6 is configuration diagram showing the main components of an imaging mass spectrometer according to the third embodiment.

The system of the second embodiment includes a dedicated section (i.e. the plate-associated data storage and management section 36) for storing detailed information about each sample plate, so that there is virtually no limitation on the amount of information to be stored. However, this system has the restriction that the stored information can be displayed or used only on the system that directly holds the information. The mass spectrometer of the third embodiment addresses this problem by forming a plurality of irradiation traces on the sample plate 3, using each irradiation trace as one pit to represent necessary information by the arrangement and number of the pits. FIG. 6 is a configuration diagram showing the main component of an imaging mass spectrometer according to the third embodiment. The same components as used in the first or second embodiment are denoted by the same numerals.

The mass spectrometer of the third embodiment includes an irradiation trace pit reader 37, a plate-associated data storage and management section 38, and an irradiation trace pit information creator 26 as functional blocks included in the controlling/processing unit 20. When the operator enters measurement information, such as the measurement date, measurement conditions, and sample identification number, through the operation unit 40 at any point in time, the irradiation trace pit information creator 26 determines, for the entered information, the number and arrangement of pits that are to be written according to a predetermined algorithm, and instructs the irradiation trace creation controller 22 to write the pits. The irradiation trace creation controller 22 controls the emission of the laser beam by the laser irradiation unit 11 and the positioning of the sample stage 2 in the x-y plane by the stage driver 17 so that the specified pit arrangement will be formed. As a result, a plurality of pits holding information are created on the sample plate 3.

After the sample plate 3 with a plurality of such pits formed thereon is set on the sample stage 2, when a specific operation is performed on the operation unit 40, the irradiation trace pit reader 37 reads and decodes the pit arrangement to restore information and show it on the display unit 41. Thus, similar to the second embodiment, it is possible to obtain, for example, information relating to the sample, the conditions of a previous measurement. Naturally, there is a limit on the amount of information to be held by the sample plate 3 since the irradiation traces can be formed within limited areas and at a density below a certain level. For example, a sample plate having 64 pits formed in an 8×8 grid pattern can hold 8 bytes of information.

Fourth Embodiment

Figure 7:
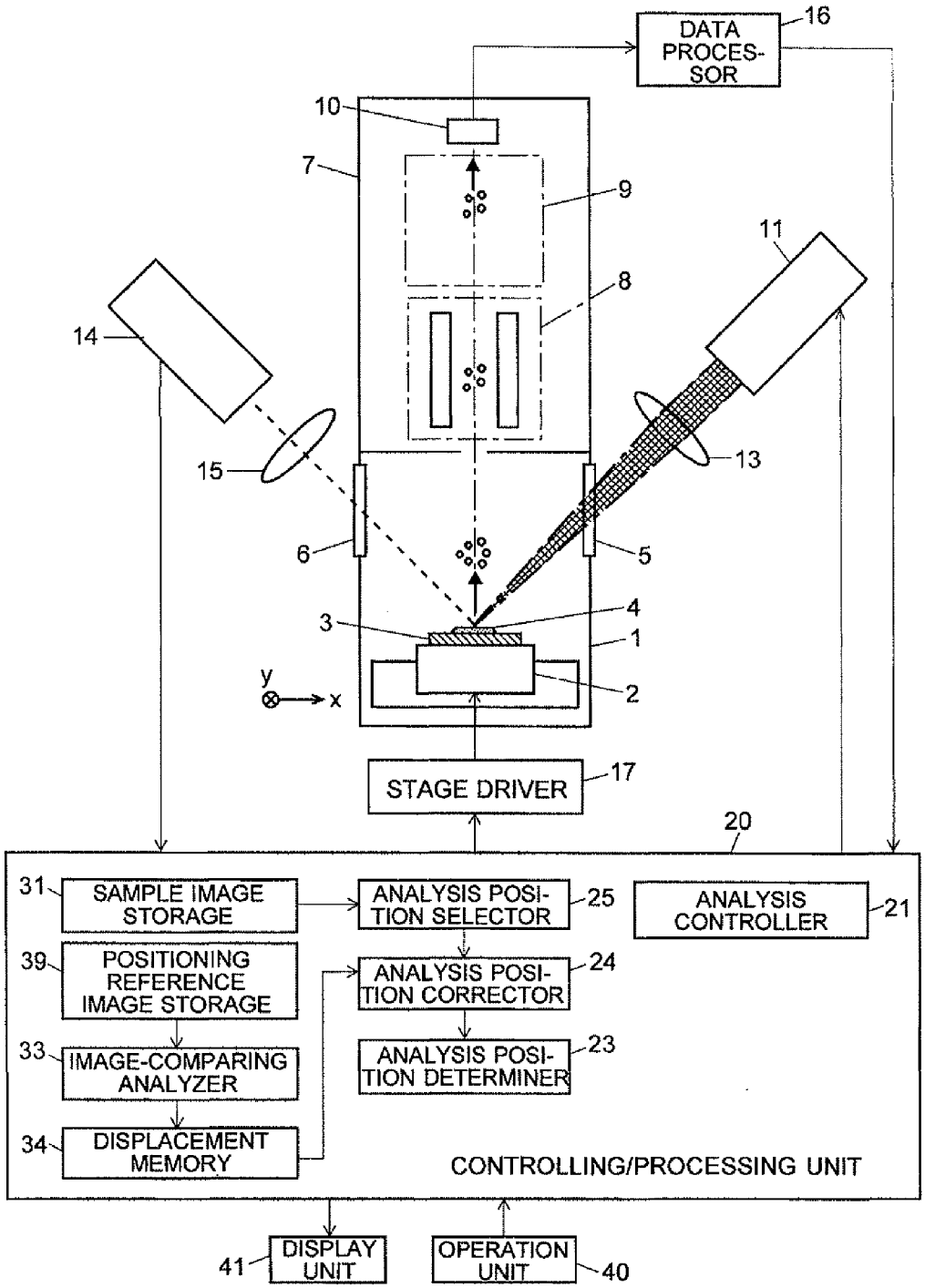
FIG. 7 is configuration diagram showing the main components of an imaging mass spectrometer according to the fourth embodiment.

An imaging mass spectrometer according to the fourth embodiment is hereinafter described. The present embodiment differs from the first embodiment in the method of calculating the displacement that occurs when the sample plate is re-set on the sample stage. FIG. 7 is a configuration diagram of the imaging mass spectrometer according to the fourth embodiment. In the first embodiment, the irradiation trace formed by throwing a laser beam onto the sample plate is used as a marker for displacement detection. In the fourth embodiment, the pattern of polishing scratches formed on the surface of each sample plate during the process of producing sample plates is used as a marker for displacement detection.

Figure 8:
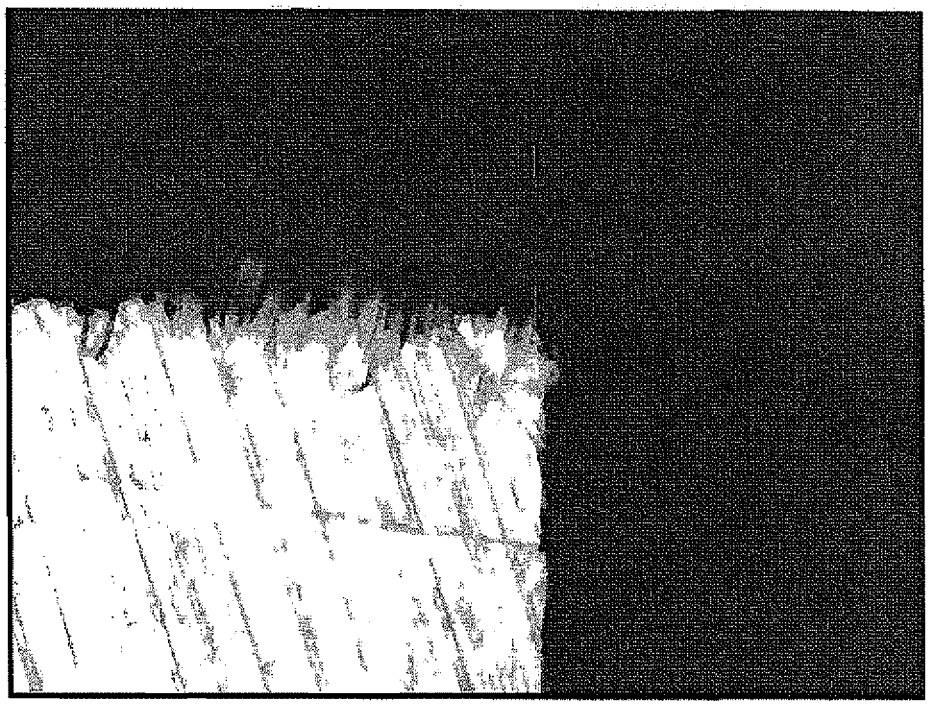
FIGS. 8(*a*) and 8(*b*) show an example of microscopic images of a corner of the sample plate.
Figure 8:
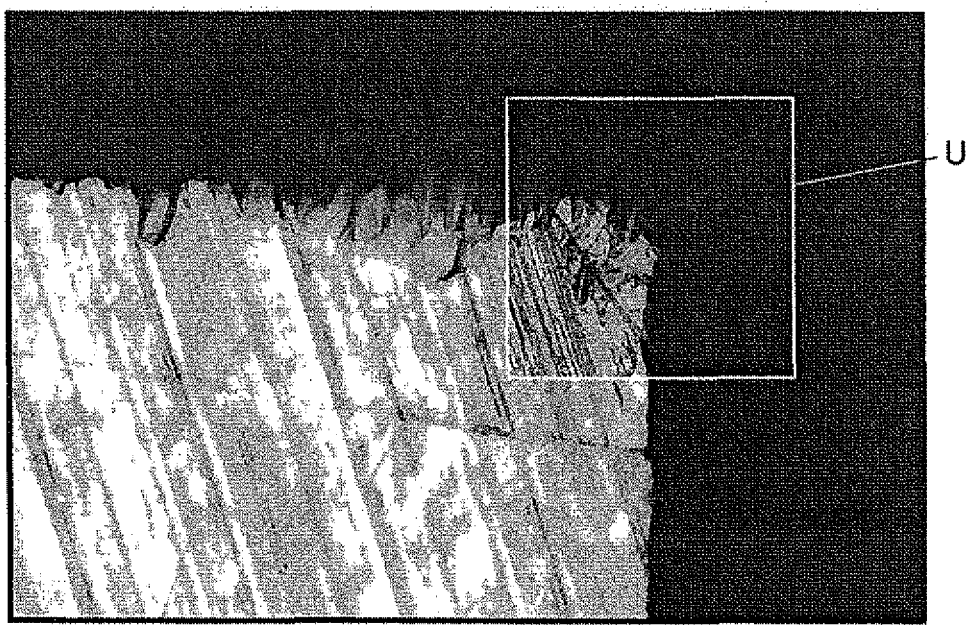

The most commonly used materials for the sample plate are quartz glass and metallic materials, such as stainless steel. In the final phase of the production of such plates, polishing work for flattening and smoothing the plate surface is normally performed. The polishing work uses abrasives, which leave a large number of fine scratches on a microscopic level with a different scratch pattern for each plate. FIG. 8(*a*) is an example of a microscopic image of one corner of a sample plate. A fine streak pattern can be seen on the surface of the sample plate. This is the polishing scratch.

In the imaging mass spectrometer of the fourth embodiment, the polishing scratch, which can be inherently found on any sample plate, is used as the marker for displacement detection. Accordingly, it does not have the irradiation trace formation controller 22, which is provided in the system of the first embodiment. Furthermore, the irradiation trace image storage section 32 is replaced with a positioning reference image storage section 39 for storing a microscopic image of the pattern of the polishing scratches formed on a specific portion (typically, one corner) of the surface of the sample plate 3. With regard to the analysis procedure, the methods of calculating and correcting the displacement after the re-setting of the sample plate are basically the same as in the first embodiment except that Steps S2 and S3 in FIG. 2 are omitted, and that a microscopic image of the pattern of polishing scratches on a specific portion of the surface of the sample plate 3 is used instead of a microscopic image of the irradiation trace on the sample plate 3. Using two or more polishing-scratch patterns to calculate the amount of displacement is also more preferable in the present case than using only one pattern.

Fifth Embodiment

As can be seen in FIG. 8(*a*), the sample plate have burrs (projections) formed on the edge of its corner. Their form is unique to this plate. Accordingly, it is possible to use a fine shape at the corner of the sample plate as the marker for displacement detection instead of the pattern of polishing scratches on the surface of the sample plate. This can be achieved by the system shown in FIG. 7 as follows: After a microscopic image of a portion near one corner of the sample plate 3 is saved in the positioning reference image storage section 39, when a sample plate with a matrix applied thereto is set on the sample stage 2, the image-comparing analyzer 33 compares a microscopic image of the portion near the corner of the sample plate 3, which is captured at that point in time, with the previous microscopic image stored in the positioning reference image storage section 39 to calculate the displacement from the difference in the position of two portions that can be regarded as the same portion.

FIG. 8(*b*) shows the result of an image analysis in which an image showing a portion near the corner of the sample plate in the microscopic image shown in FIG. 8(*a*) was used as the reference image for displacement detection, and a portion that could be regarded as the same as the aforementioned portion was extracted from a microscopic image of the same sample plate after the matrix was applied to it. The range indicated by the rectangular frame labeled "U" in FIG. 8(*b*) shows the edge of the corner of the sample plate and the contours of the surface pattern extracted by image recognition. With the same portion thus correctly identified, it is possible to accurately calculate the amount of displacement from the difference in the position of that portion between the two images.

Similar to the first embodiment, the unique pattern of polishing scratches on the surface of the sample plate or the unique shape of the corner of the sample plate can also be utilized in the fourth and fifth embodiments in such a manner that data representing the characteristic pattern or shape are associated with plate-associated data and stored. By this data management method, a correct set of information relating to the sample plate to be analyzed can be quickly displayed.

It should be noted that the previous embodiments are mere examples of the present invention, and any change, modification or addition appropriately made within the spirit of the present invention will be naturally included in the scope of claims of the present patent application.

What is claimed is:

1. A mass spectrometer comprising:

an apparatus body in which a removable sample plate can be set and an ion source for ionizing a sample by a matrix assisted laser desorption ionization method including successive steps of applying a matrix to a sample held on the sample plate removed from the apparatus body, setting the sample plate in the apparatus body, and throwing a laser beam from a laser irradiation unit onto the sample with the matrix applied thereto to ionize the sample;

an irradiation trace formation means for forming an irradiation trace on the sample plate by throwing a laser beam from the laser irradiation unit to a predetermined position on the sample plate when the sample plate is set in the apparatus body, the laser beam having a higher energy than in the process of ionizing the sample;

a reference image capture means for capturing a microscopic image including the irradiation trace on the sample plate when the sample plate carrying the sample with no matrix applied thereto and having the irradiation trace formed thereon is set in the apparatus body, and for saving the captured image as a reference image; and an irradiation trace identifier for recognizing a visual feature of the irradiation trace and identifying the sample plate on the basis of the visual feature of the irradiation trace.

2. The mass spectrometer according to claim 1, further comprising:

an information memory means for using, as an identifier, the visual feature of the irradiation trace formed on the sample plate by the irradiation trace formation means, for associating information relating to the sample plate, the measurement or the sample with the identifier, and for memorizing this information; and an information retrieval means for recognizing the visual feature of the irradiation trace on a microscopic image of the sample plate taken when the sample plate is set in the apparatus body, and for referring to the information memory means to retrieve and output the information corresponding to the sample plate concerned.

3. The mass spectrometer according to claim 1, wherein information relating to the sample plate or the measurement is associated with an arrangement or pattern of a plurality of irradiation traces formed on the sample plate by the irradiation trace formation means so that the sample plate itself can hold the aforementioned information.

4. The mass spectrometer according to claim 1, further comprising:

an x-y plane displacement detection means for calculating magnitude and direction of an x-y plane displacement of the sample plate occurring when the sample plate is re-set in the apparatus body, based on a change in an x-y plane position of the irradiation trace observed on both the reference image and a microscopic image including the irradiation trace on the sample plate, the latter image being obtained when the sample plate carrying the sample with the matrix applied thereto is set in the apparatus body; and an x-y plane displacement correction means for changing a relative x-y plane position between the laser beam from the laser irradiation unit and the sample so as to cancel the x-y plane displacement calculated by the x-y plane displacement detection means, before a mass analysis is performed on an area of analysis on the sample, the area of analysis being selected with reference to a microscopic image of the sample captured concurrently with the capturing of the reference image.

5. The mass spectrometer according to claim 4, wherein the irradiation trace identifier shows an alert or prohibits an initiation of a mass analysis when a sample plate with a matrix applied thereto is set in the apparatus body and there is no reference image that shows an irradiation trace having a same visual feature as that of the irradiation trace on the sample plate.

6. The mass spectrometer according to claim 1, wherein the irradiation trace is a deformation of the surface of the sample plate by application of laser heat.

7. The mass spectrometer according to claim 1, wherein the irradiation trace is a pit or a hole.

8. A mass spectrometer comprising:

an apparatus body in which a removable sample plate can be set and an ion source for ionizing a sample by a matrix assisted laser desorption ionization method including successive steps of applying a matrix to a sample held on the sample plate removed from the apparatus body, setting the sample plate in the apparatus body, and throwing a laser beam from a laser irradiation unit onto the sample with the matrix applied thereto to ionize the sample;

a reference image capture means for capturing a microscopic image of the surface of the sample plate when the sample plate carrying the sample with no matrix applied thereto is set in the apparatus body, and for saving the captured image as a reference image;

a scratch pattern identifier for recognizing a visual feature of a scratch pattern inherently and uniquely formed thereon and identifying the sample plate on the basis of the visual feature of the scratch pattern;

an x-y plane displacement detection means for calculating magnitude and direction of an x-y plane displacement of the sample plate occurring when the sample plate is re-set in the apparatus body, based on a change in an x-y plane position of the scratch pattern recognized on both the reference image and a microscopic image of a surface of the sample plate, the latter image being obtained when the sample plate carrying the sample with the matrix applied thereto is set in the apparatus body, and the scratch pattern being formed on the surface of the sample plate in a process of producing the sample plate; and an x-y plane displacement correction means for changing a relative x-y plane position between the laser beam from the laser irradiation unit and the sample so as to cancel the x-y plane displacement calculated by the x-y plane displacement detection means, before a mass analysis is performed on an area of analysis on the sample, the area of analysis being selected with reference to a microscopic image of the sample captured concurrently with the capturing of the reference image.

9. A mass spectrometer comprising:

an apparatus body in which a removable sample plate can be set and an ion source for ionizing a sample by a matrix assisted laser desorption ionization method including successive steps of applying a matrix to a sample held on the sample plate removed from the apparatus body, setting the sample plate in the apparatus body, and throwing a laser beam from a laser irradiation unit onto the sample with the matrix applied thereto to ionize the sample;

a reference image capture means for capturing a microscopic image including a corner of the sample plate when the sample plate carrying the sample with no matrix applied thereto is set in the apparatus body, and for saving the captured image as a reference image;

an identifier for recognizing a visual feature of a projection of a corner of the sample plate, the projection being inherently and uniquely formed, and identifying the sample plate on the basis of the visual feature of the projection of the corner of the sample plate;

an x-y plane displacement detection means for calculating magnitude and direction of an x-y plane displacement of the sample plate occurring when the sample plate is re-set in the apparatus body, based on a change in the x-y plane position of the corner recognized on both the reference image and a microscopic image including the corner of the sample plate, the latter image being obtained when the sample plate carrying the sample with the matrix applied thereto is set in the apparatus body; and an x-y plane displacement correction means for changing a relative x-y plane position between the laser beam from the laser irradiation unit and the sample so as to cancel the x-y plane displacement calculated by the x-y plane displacement detection means, before a mass analysis is performed on an area of analysis on the sample, the area of analysis being selected with reference to a microscopic image of the sample captured concurrently with the capturing of the reference image.

10. The mass spectrometer according to claim 8, wherein the scratch pattern identifier shows an alert or prohibits an initiation of a mass analysis when a sample plate with a matrix applied thereto is set in the apparatus body and there is no reference image that shows a scratch pattern having a same visual feature as that of the scratch pattern on the sample plate.

11. The mass spectrometer according to claim 9, wherein the identifier shows an alert or prohibits an initiation of a mass analysis when a sample plate with a matrix applied thereto is set in the apparatus body and there is no reference image that shows a projection of a corner of a sample plate having a same visual feature as that of the projection of the corner of the sample plate on the sample plate.

* * * * *